US006064711A

United States Patent [19]

Copson

[11] Patent Number: 6,064,711

[45] Date of Patent: May 16, 2000

[54] FLAK JACKET PROTECTIVE COVER FOR SPENT NUCLEAR FUEL STORAGE CASKS

[75] Inventor: Alex G. Copson, Washington, D.C.

[73] Assignee: International Fuel Containers, Inc., New York, N.Y.

[21] Appl. No.: 09/213,903

[22] Filed: Dec. 17, 1998

Related U.S. Application Data

[63] Continuation-in-part of application No. 08/871,622, Jun. 9, 1997, Pat. No. 5,852,643.

[51] Int. Cl.[7] ..... G21C 9/00; G21C 19/00

[52] U.S. Cl. ..... 376/287; 376/272; 250/506.1; 250/507.1; 250/517.1

[58] Field of Search ..... 376/272, 287; 250/506.1, 507.1, 515.1, 517.1; 89/36.02

[56] References Cited

U.S. PATENT DOCUMENTS

| | | | |
|---|---|---|---|
| 4,527,066 | 7/1985 | Dyck et al. | 376/272 |
| 4,532,104 | 7/1985 | Wearden et al. | 376/272 |
| 4,666,659 | 5/1987 | Lusk et al. | 376/272 |
| 4,881,448 | 11/1989 | Medin et al. | 89/36.02 |
| 4,972,087 | 11/1990 | Neider et al. | 250/507.1 |
| 5,059,467 | 10/1991 | Berkovitz | 89/36.02 |
| 5,070,764 | 12/1991 | Shevach et al. | 89/36.17 |
| 5,149,910 | 9/1992 | Mckee | 89/36.02 |
| 5,200,256 | 4/1993 | Dunbar | 89/36.01 |
| 5,272,954 | 12/1993 | Crouch | 89/36.02 |
| 5,370,034 | 12/1994 | Turner et al. | 89/36.02 |
| 5,400,688 | 3/1995 | Eninger et al. | 89/36.12 |
| 5,402,703 | 4/1995 | Drotleff | 89/36.02 |
| 5,429,031 | 7/1995 | Merendino | 89/36.02 |
| 5,471,904 | 12/1995 | Martin | 89/36.02 |
| 5,610,363 | 3/1997 | Crews et al. | 89/36.02 |

*Primary Examiner*—Charles T. Jordan
*Assistant Examiner*—Jack Keith
*Attorney, Agent, or Firm*—Birch, Stewart, Kolasch & Birch, LLP

[57] ABSTRACT

Spent nuclear fuel storage casks, particularly a protective and venting cover for such storage casks which are stored above ground. The protective and venting cover may be assembled from annular or doughnut-shaped cast concrete members stacked one upon the other and/or steel members extending the height of the storage cask. The annuli are axially indexed with respect to the storage cask, such that a venting annulus is formed about the storage cask and the annulus contributes to a defocusing geometry against armor piercing weapons, such an anti-tank "shaped charge" weaponry.

34 Claims, 12 Drawing Sheets

FLAK JACKET PROTECTIVE COVER FOR SPENT NUCLEAR FUEL STORAGE CASKS

CROSS-REFERENCE TO RELATED APPLICATION

This application is a Continuation-in-Part of application Ser. No. 08/871,622, filed Jun. 9, 1997, now U.S. Pat. No. 5,852,643.

BACKGROUND OF THE INVENTION

A flak jacket (or "tea-caddy") protective cover for spent nuclear fuel casks of the type containing spent nuclear fuel rods, and the like. Conventionally, the storage casks are cylindrical iron containers, approximately eight feet in diameter and eighteen feet in height. The casks are stored on site at nuclear generating facility, either in a pond or they are stacked above ground. In either case, the vulnerability of the casks to terrorist attack is manifest.

SUMMARY OF THE INVENTION

Applicant's flak jacket protective cover is designed for ready encasement of the spent nuclear fuel storage cask as a protection against armor piercing weaponry and the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
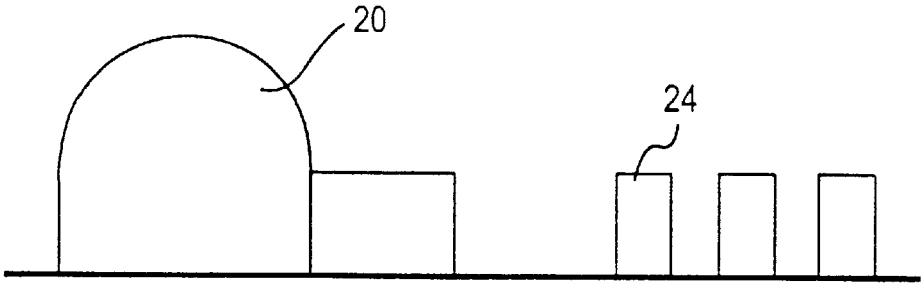
FIG. 1 is an elevational schematic view of a conventional nuclear generation facility with spent nuclear fuel storage casks positioned above ground and in vulnerable array.

In FIG. 1, nuclear generating facility 20 is illustrated with its conventional transportable spent nuclear fuel casks 24, stored adjacently above ground.

Figure 2:
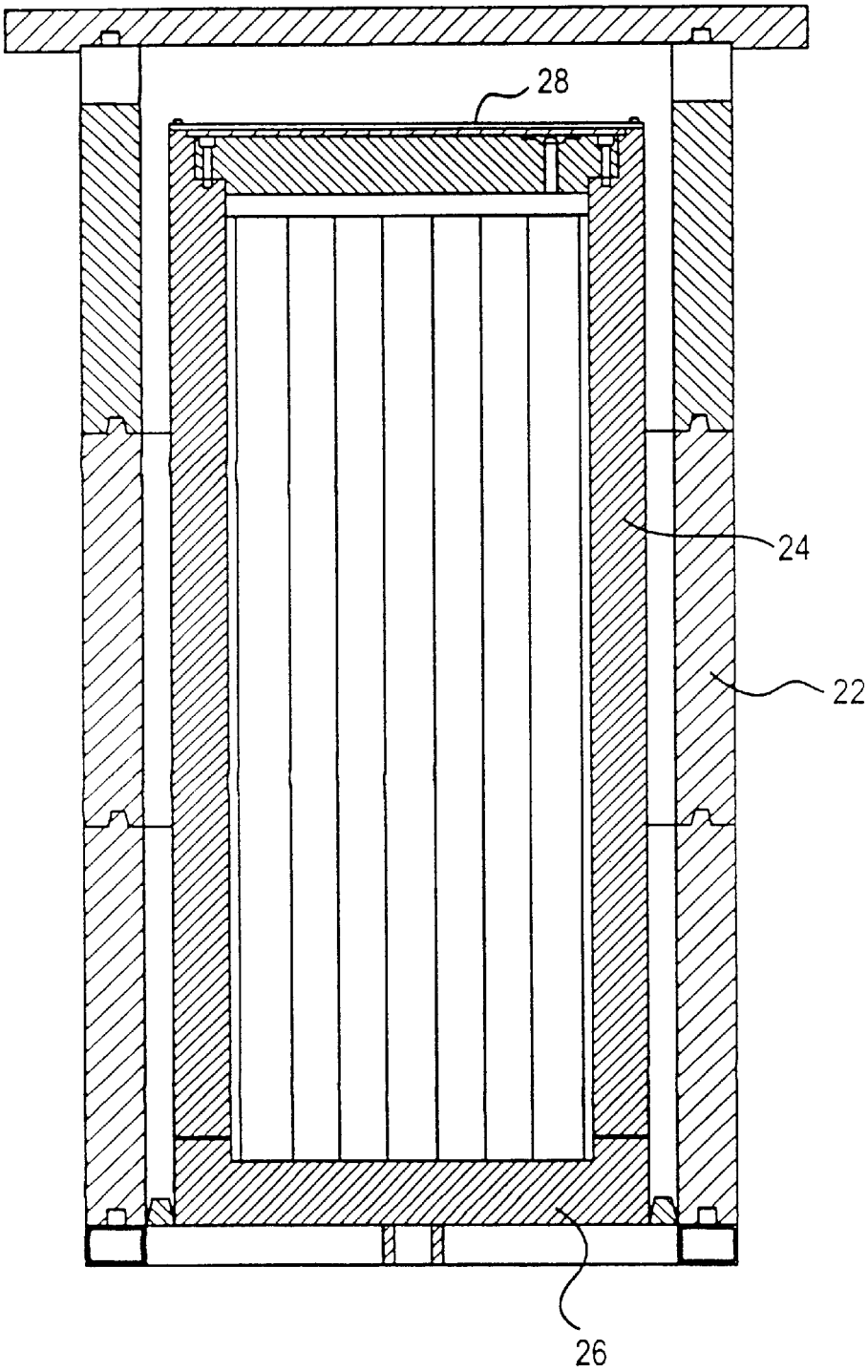
FIG. 2 is a vertical sectional view of a spent nuclear storage fuel cask of the type having venting apertures and manufactured by Gesellschaft Fur Nuklear Services, GmbH of Essen, Germany.

FIG. 2 is a vertical sectional view of a conventional spent nuclear fuel storage cask 24 with top closure 28, including welded plate, and bottom closure 26, enclosed overall by a concrete and ceramic shelter 22.

Figure 3:
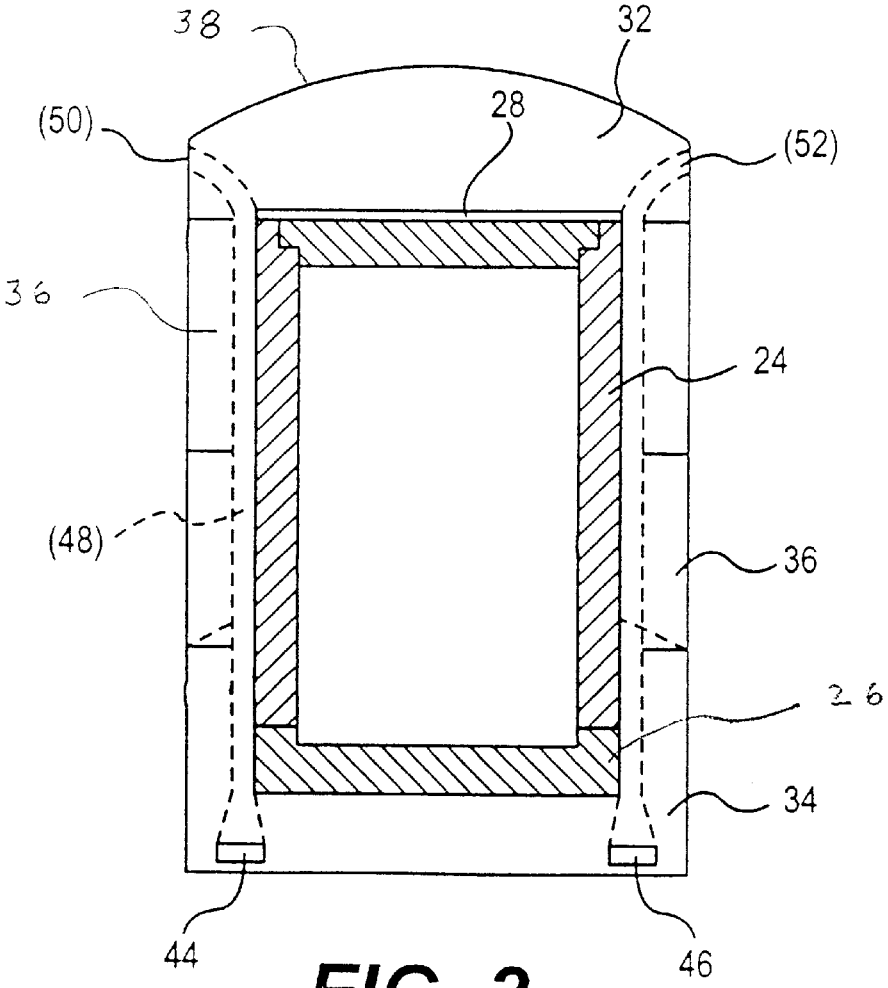
FIG. 3 is a vertical elevation, partially in phantom and in section, showing a proposed flak jacket protective cover comprised of an annular or doughnut-shaped base with stackable annular mid-portions and a doughnut-shaped cover enclosing the storage cask.

FIG. 3 is an illustration of applicant's flak jacket protective cover 32 enclosing conventional storage cask 24 with bottom member 26 and welded iron top closure 28.

Applicant's flak jacket protective cover 32 is comprised of annular or doughnut-shaped base section 34, a plurality of complementary annular stackable mid-sections 36 and top 38, which has air vents 50, 52. Base 34 may have vents 44, 46 communicating with the venting annulus 48 intermediate the doughnut's inner portion and the exterior of cask 24. The inner venting annulus is at least six inches in lateral width.

Figure 4:
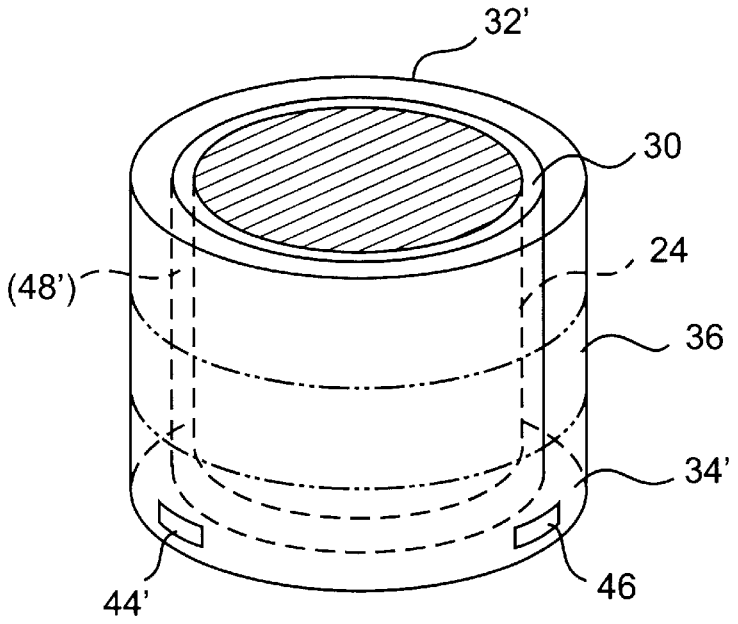
FIG. 4 is a vertical elevation, partially in phantom and in section, showing a modified flak jacket protective cover positioned about an indexing cylinder which in turn is fitted over the spent nuclear fuel storage cask.

In FIG. 4 there is illustrated a modified flak jacket protective cover 32' which is indexed about the storage cask 24 by means of indexing cylinder 30. Indexing cylinder 30 is constructed from steel or similar material and has a width equal to the width of the inner venting annulus. The indexing cylinder is positioned around storage cask 24 in order to guide the base section 34' into position. The indexing cylinder is then removed, and the base section 34" is used to index the stackable mid-sections 36. Doughnut-shaped base section 34' embodies venting ports 44', 46', and annular top 38' (not shown) embodies venting ports 50', 52' (not shown), communicating with venting annulus 48'.

Figure 5:
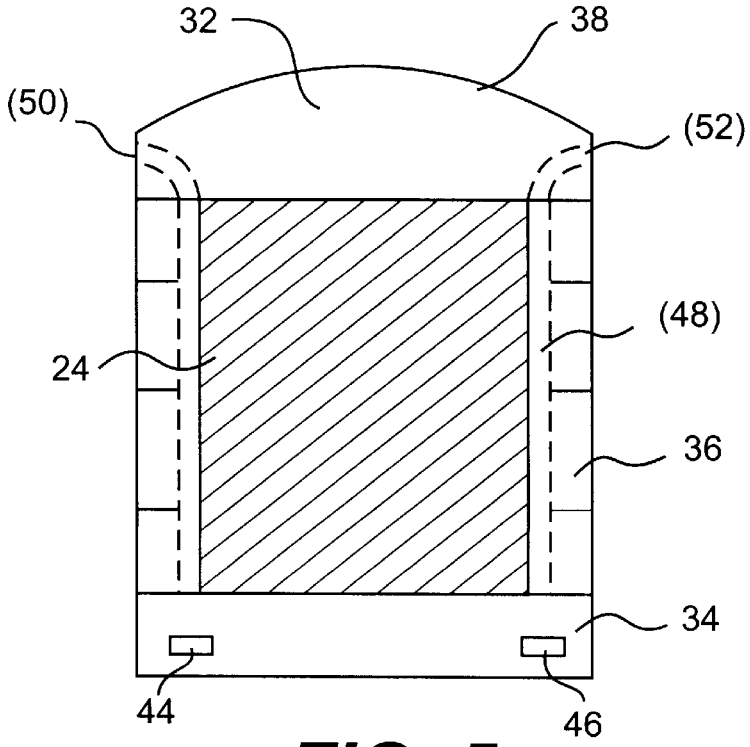
FIG. 5 is a simplified schematic view of the flak jacket protective cover, illustrated in FIG. 3.

In FIG. 5 there is illustrated schematically the FIG. 3 arrangement, where there is full venting of the storage cask 24 exterior by means of vents 44, 46 within bottom annular base 34 and vents 50, 52 within annular top 38.

Figure 6:
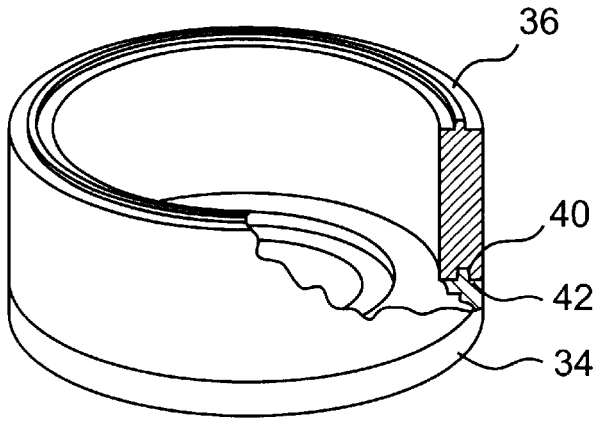
FIG. 6 is an exploded view, partially in phantom and in section, showing the means of fitting the annular mid-portions 36 onto each other and onto the base portion 34 by means, respectively, of a complementary indexing ridge and notch.

In FIG. 6 there is an exploded view of the fitting of mid-portion annulus 36 upon annular base 34 by means, respectively of complementary indexing groove 42 and complementary indexing ridge 40. The remaining mid-portion annulus and top 32 may be similarly indexed to each other.

Figure 7:
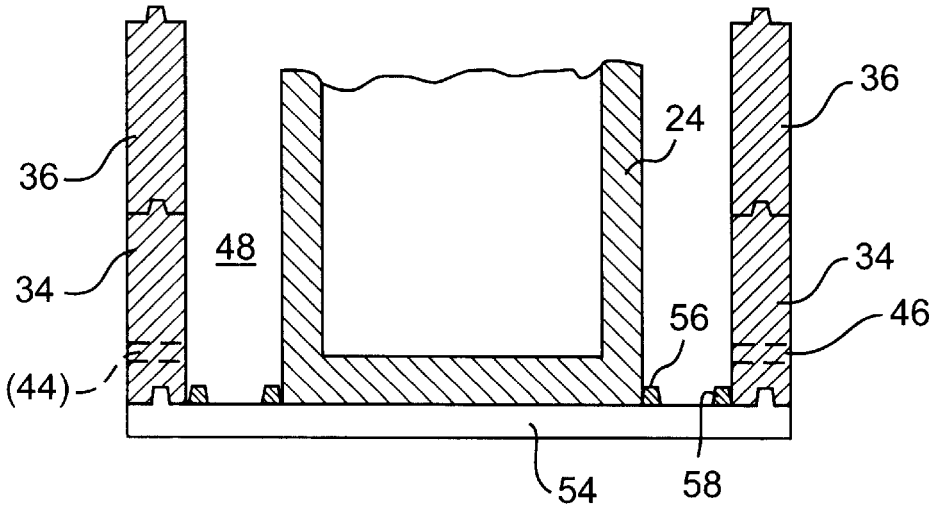
FIG. 7 is a fragmentary elevation, partially in section, showing the fitting of the base and mid-portion annular elements upon an especially adapted support plate with indexing ridges.

FIG. 7 illustrates a modified base plate 54 embodying circular indexing ridge 56 for indexing storage cask 24 and circular indexing ridge 58 for indexing annular base member 34. A base annular member 34 is provided with venting ports 44 and 46.

Figure 8:
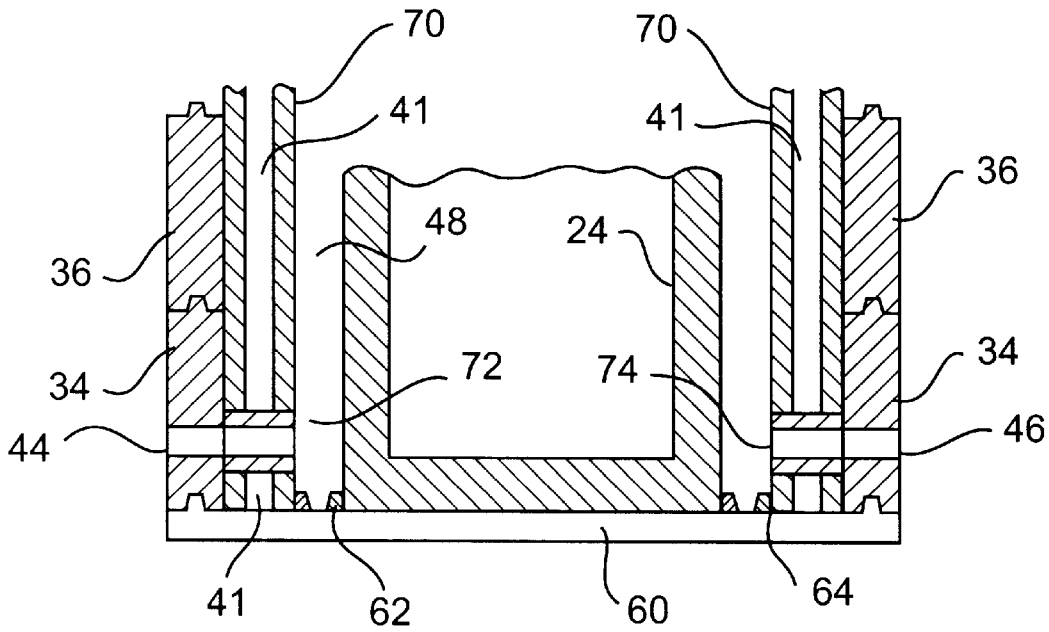
FIG. 8 is a fragmentary elevational view, partially in section, showing a double wall indexing annulus, wherein liquid, sand, cement, or the like, may be pumped into the indexing annulus walls.

FIG. 8 illustrates a further modified base plate 60 having an inner circular indexing ridge 62 for the storage cask 24 and an outer circular indexing ridge 64 for a double wall annulus 70 into which cement, sand, water, or the like, may be pumped into the space 41. Annulus 70 may have lower venting ports 72, 74 formed by a tube extending through and sealingly connecting the two walls of the annulus 70. The ports 72, 74 communicate with venting ports 44, 46 in base annular member 34.

Figure 9:
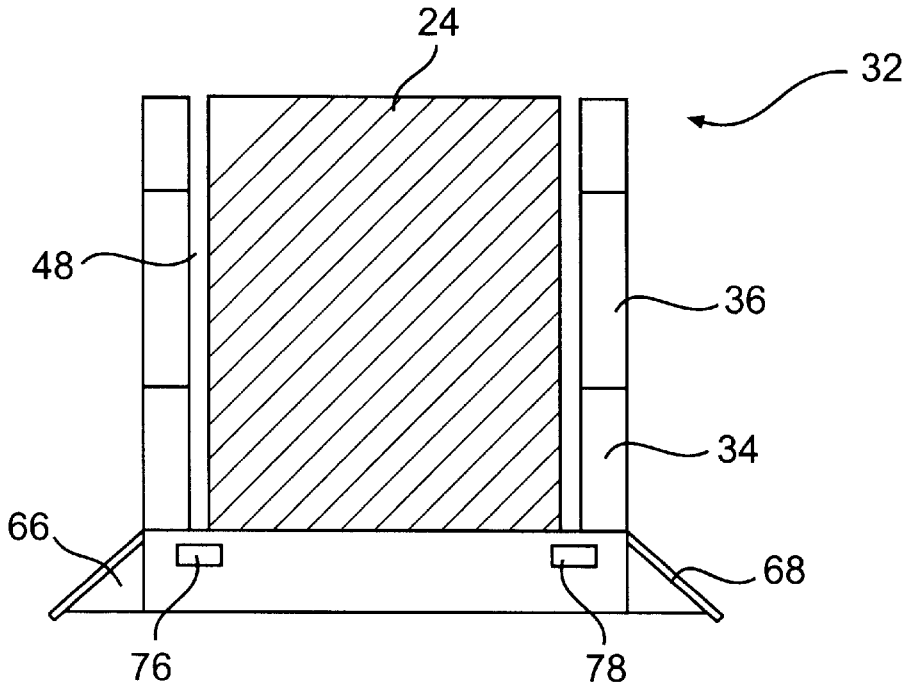
FIG. 9 is a fragmentary elevational view, partially in section, showing the support of the storage cask and the flak jacket protective cover upon a specially adapted base with inclined flange supports and venting ports.
Figure 10:
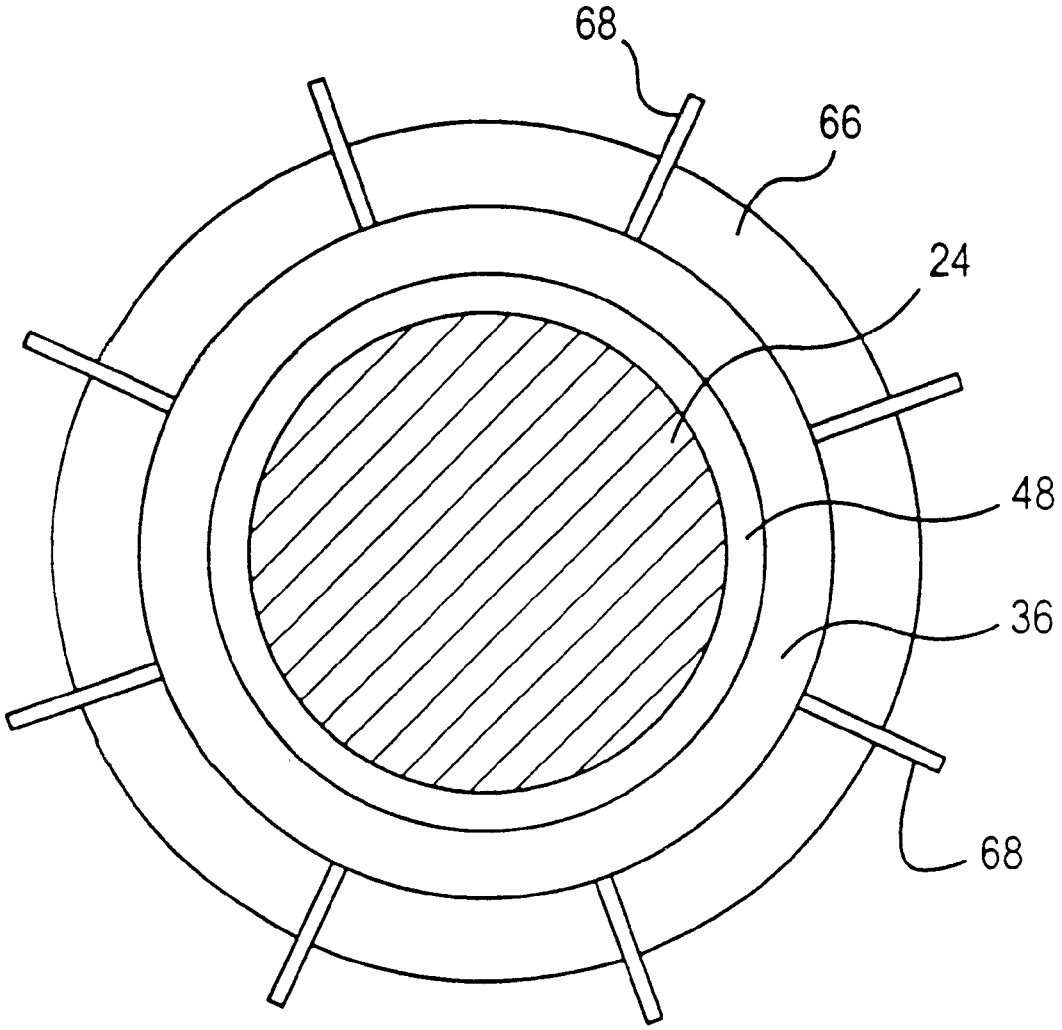
FIG. 10 is a top plan, partially in section, of the modified protective cover and stand illustrated in FIG. 9.

FIG. 9 and FIG. 10 illustrate a further modified and inclined base 66 supported by radially extending leg members 68, such that the flak jacket protective cover 32 and storage cask 24 are supported above the base 66 with full venting through venting ports 76, 78.

Figure 11:
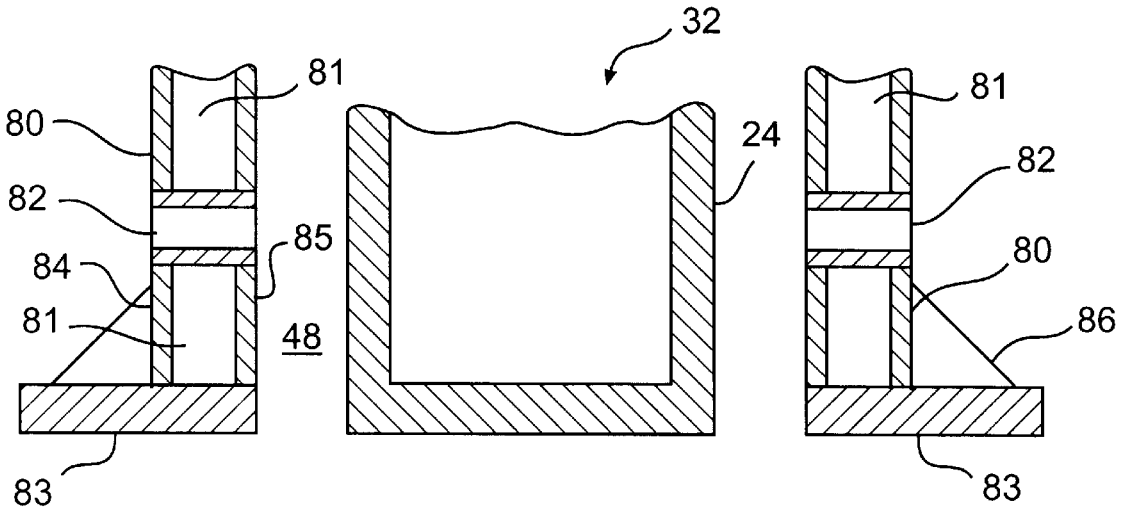
FIG. 11 is a fragmentary elevational view, partially in section, illustrating an indexing cylinder positioned at a predetermined location from the storage cask.

FIG. 11 illustrates another embodiment of the present invention. FIG. 11 is a cross-sectional view of the bottom portion of the embodiment. Storage cask 24 is separated by a venting annulus 48 from a steel tube 80. The steel tube 80 is a double wall cylinder having a space 81 between the two walls 84 and 85. A base 83 is secured to a bottom portion of the tube 80 by welding The steel tube 80 also includes a venting port 82 in communication with the venting annulus 48 and the outside atmosphere. The venting port 82 is formed from a tube of round, square or other shaped cross-section which extends between the walls 84 and 85 of the steel tube 80 and seals the space 81 inside the steel tube from the venting annulus 48 and the outside atmosphere. The space 81 can be filled with water, sand, ceramic material, cement, or the like, in order to increase the penetration resistance of the steel tube 80. Gussets 86 are welded between the base 83 and the tube 80 in order to strengthen the connection therebetween. It is noted that FIG. 11 illustrates only two venting ports 82 and two gussets 86, however, additional venting ports and gussets may be provided at various spaced locations around the circumference of the steel tube 80.

Figure 12:
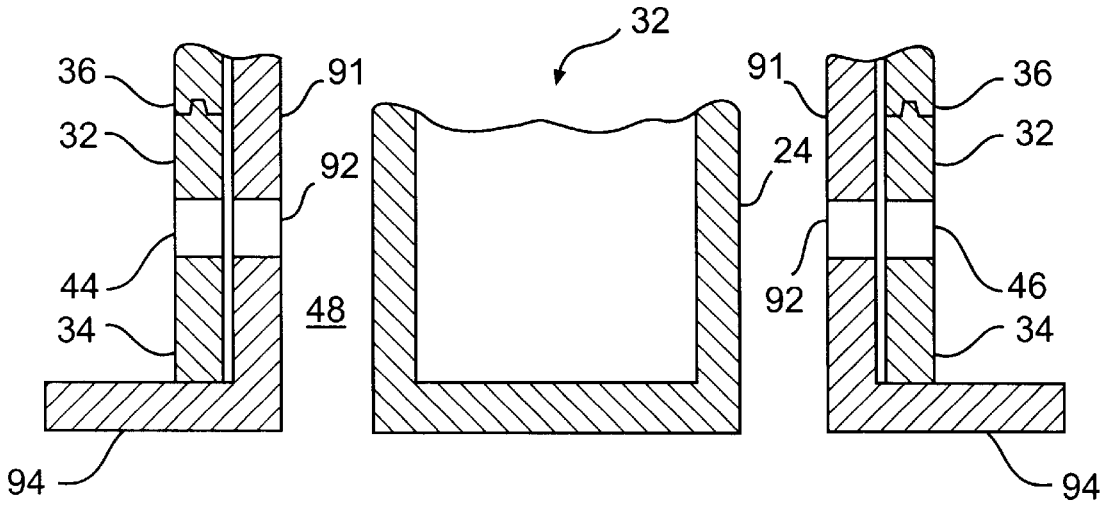
FIG. 12 is a fragmentary elevational view, partially in section, illustrating an indexing cylinder and base annular member positioned at a predetermined distance from the storage cask.

FIG. 12 illustrates another embodiment of the present invention. FIG. 12 is a cross-sectional view of a bottom portion of the flak jacket protective cover as in FIG. 11. In this embodiment, however, a steel cylinder 91 is provided at a spaced location from the storage cask 24 forming a venting annulus 48 therebetween. The steel cylinder includes a base 94 connected to a lower portion thereof. Furthermore, a base annular member 34 made of cement is supported around the steel cylinder 91 on base 94. Both the steel cylinder 91 and the base annular member 34 include venting ports 92 and 44, 46, respectively, for communicating the venting annulus 48 with the outside atmosphere.

Figure 13:
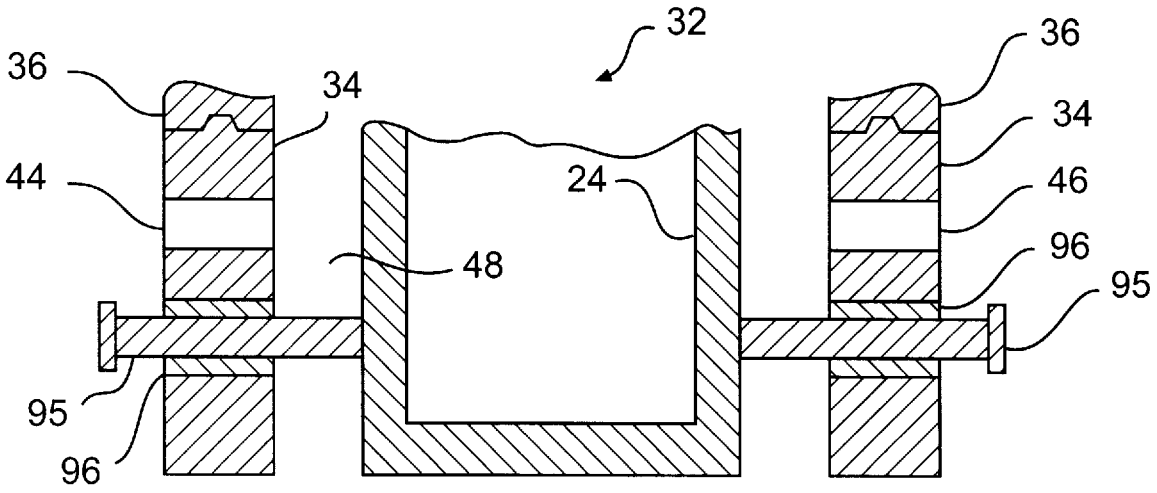
FIG. 13 is a fragmentary elevational view, partially in section, illustrating a base annular member and screws for indexing the base annular member from the storage cask.

FIG. 13 illustrates another embodiment of the present invention. A base annular member 34 is positioned at a spaced location from the storage cast 24 forming a venting annulus 48 therebetween. Adjustable screws 95 are supported in the base annular member 34 by a threaded sleeve 96 in order to index the base annular member 34 a predetermined distance from the storage cast 24. Furthermore, venting ports 44 and 46 may be provided in the base annular member 34 in order to communicate the venting annulus 48 with the outside atmosphere.

In FIGS. 11–13, base 83, base 94 and the bottom of base annular member 34, respectively, are supported directly on a level portion of the ground along with the storage cask 24. The weight of the cement and steel used in making the flak jacket protective cover 32 is enough to ensure that the cover stays in place. The flak jacket protective cover 32 can therefore be used with a storage cask which is already existing at a particular location. The members of the flak jacket protective cover are simply positioned over the storage cask from above, the weight of the members ensuring that the flak jacket protective cover remains in place.

Figure 14:
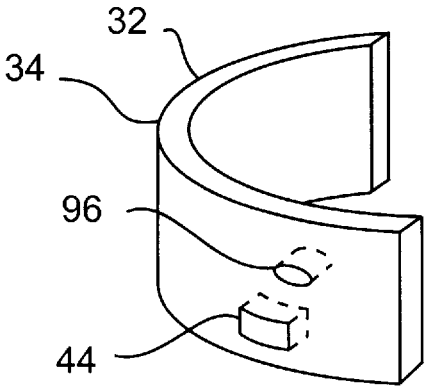
FIG. 14 is a perspective view of an alternative embodiment of the base annular member.

Referring to FIG. 14, an alternative embodiment of the base annular member 34 is illustrated. The base annular member 34 is formed from two half cylinders, only one of which is shown in the figure. The two half cylinders are secured around a storage cask 24 from the sides in order to eliminate the need for raising the annular pieces up over the top of the cask. The two halves have complementary ridges and grooves (not shown) to ensure that the two pieces fit together properly, as well as ridges and grooves as in FIG. 6 for stacking. The annular members can be used either with an embodiment having a base, such as that shown in FIG. 6, an embodiment such as that shown in FIG. 12, or any other embodiment that includes a base annular member 34. As illustrated in FIG. 14, the base annular member 34 may include a threaded sleeve 96 for use with the embodiment of FIG. 13, and a venting port 44. It is noted that only one venting port 44 and one threaded sleeve 96 is illustrated in FIG. 14 for the illustrated half cylinder. However, there may be provided additional venting ports and sleeves around the circumference of the half cylinder.

In any of the embodiments illustrated in FIG. 12 to FIG. 14, the base annular member 34 is provided with a venting port and additional annular mid pieces 36 may be stacked on top of the base annular member 34 in order to cover the entire storage cask. Furthermore, an annular top 38 may be provided to protect the storage cask from above. The annular top 38 may include venting ports communicating with the inner venting annulus as in the previous embodiments.

Figure 15:
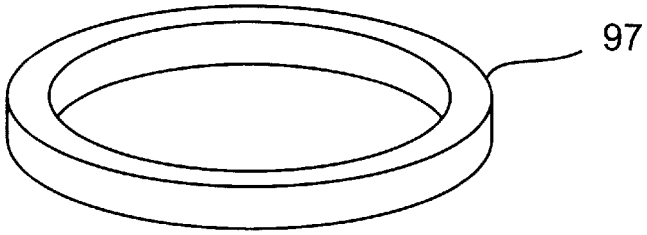
FIG. 15 and FIG. 16 illustrate an alternative embodiment having an indexing ring for spacing the base annular member from the storage cask.
Figure 16:
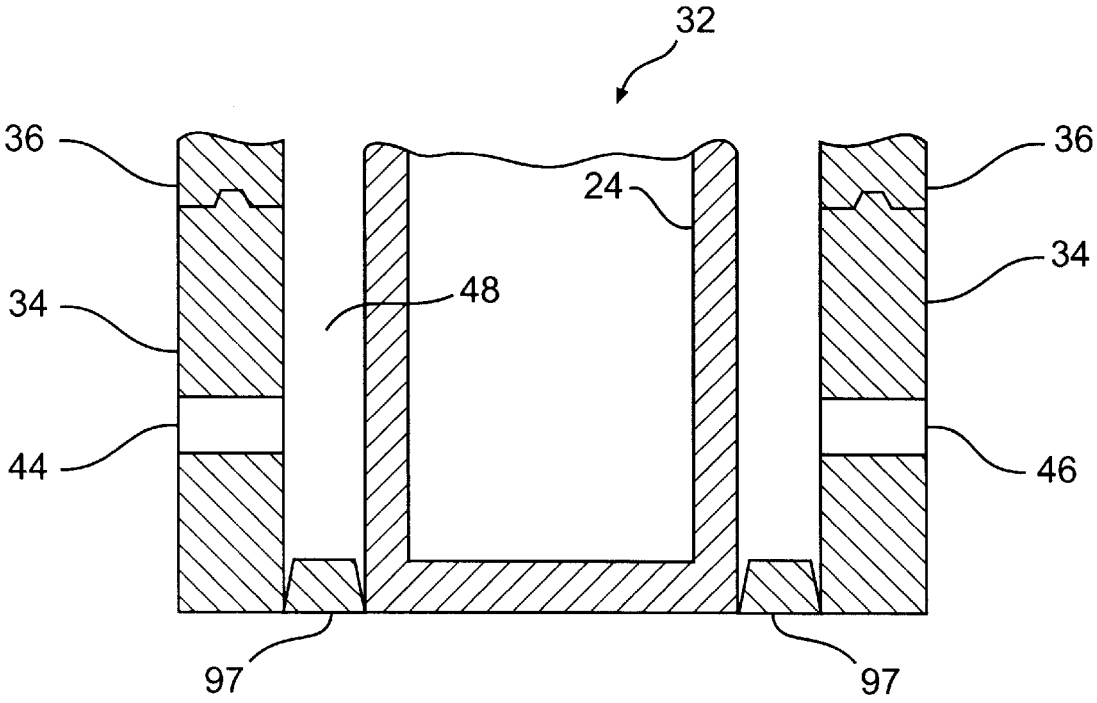

FIGS. 15 and 16 illustrate another embodiment of the present invention. A base annular member 34 is illustrated in FIG. 16 positioned at a predetermined distance around the outside of the storage cask 24. An indexing ring 97 is used to space the base annular member 34 the predetermined distance from the storage cask. Venting ports 44 and 46 are illustrated communicating with the inner venting annulus 48. Furthermore, annular mid pieces 36 are illustrated stacked on top of the base annular member 34. As illustrated in FIG. 15, the indexing ring 97 is an annular member which has a thickness substantially the same as the inner venting annulus 48. Therefore, by positioning the indexing ring 97 around the outside surface of the storage cask 24 proper indexing of the base annular member 34 is achieved.

Figure 17:
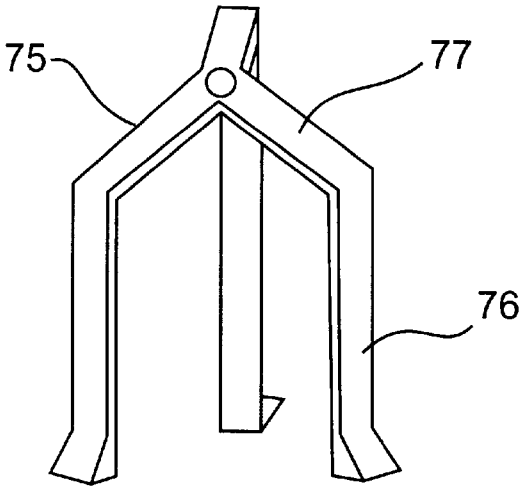
FIG. 17 is a perspective view of a spider guide of the present invention.
Figure 18:
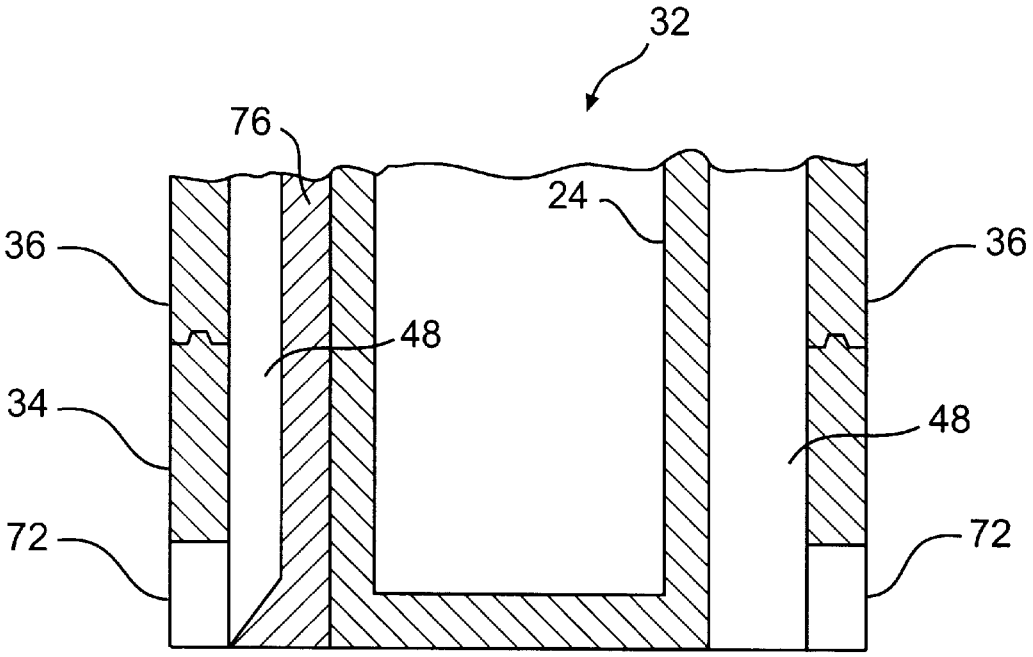
FIG. 18 is an elevational view, partly in section, of the embodiment of FIG. 17 illustrating the spider guide between the base annular member and the storage cask.

FIGS. 17 and 18 illustrate a further embodiment of the present invention. A storage cask 24 is illustrated within a base annular member 34. The base annular member 34 is spaced from the storage cask 24 by a venting annulus 48. In order to ensure that the base annular member is positioned at the proper distance from the storage cask 24, a spider guide 77 is first positioned over the storage cask. The spider guide 77 acts as indexing means to guide the base annular member 34 into position. Once the base annular member 34 is positioned in the proper location by means of the spider guide, the spider guide is removed in order to reuse the spider guide for indexing base annular members around additional storage casks.

Once the base annular member 34 is positioned properly, stackable midsections 36 are positioned on top of the base annular member 34. The previously positioned base annular member acts as indexing means for the proper position of the stackable mid-sections 36. It is also possible to leave the spider guide in place until all of the stackable mid-sections are positioned and then remove the spider guide. This will help to guide the stackable mid-sections into position while the spider guide protects the storage cask 24 from damage during installation.

Referring to FIG. 17, the spider guide 77 is illustrated in perspective view. The spider guide 77 includes vertical legs 76 and horizontal sections 75. In the embodiment of FIG. 17, the spider guide 77 is illustrated having three vertical legs and three horizontal sections; however, the spider guide 77 may include additional legs.

Referring to FIG. 18, the base annular member includes castling around the bottom in order to provide venting to the inner venting annulus 48. The castling extends completely around the circumference of the base annular member.

Figure 19:
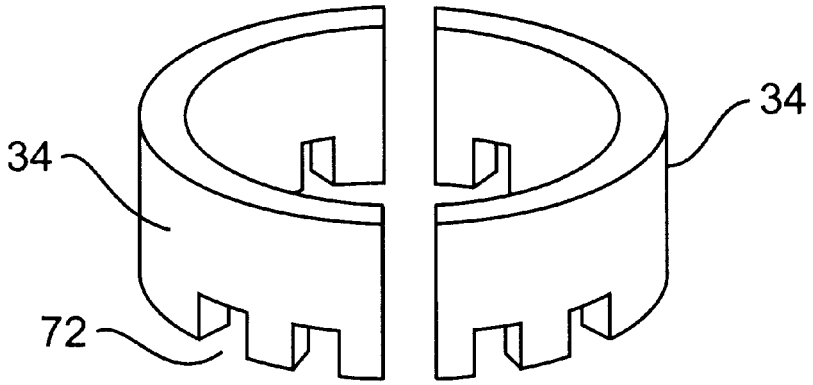
FIG. 19 and FIG. 20 are perspective views of alternative embodiments of the base annular member.
Figure 20:
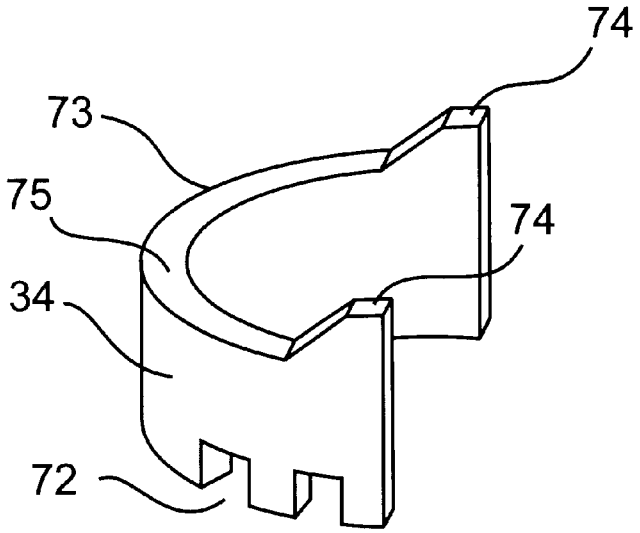

Referring to FIG. 19 and FIG. 20, alternative embodiments of the base annular member 34 are illustrated. Each of the embodiments includes castling 72 around the bottom for venting and are formed from half cylinders which are positioned around the storage cask from the sides as in the embodiment of FIG. 14. The embodiment of FIG. 19 has a flat upper surface which may include complementary indexing ridges as in the embodiment of FIG. 6.

Referring to FIG. 20 the base annular member 34 of this embodiment includes a locking upper surface 73. The locking upper surface 73 includes raised portions 74 and lowered portions 75. One of the base annular members 34 is positioned at a predetermined position from the side of the storage cask and a matching base annular member 34 is positioned from the opposite side. Each of the base annular members includes the raised and lowered portions 74 and 75. Once the base annular members 34 are positioned, stackable midsections are positioned on top of the base annular members 34, the stackable mid-sections including complementary locking surfaces to the locking upper surfaces 73 of the base annular members 34. The stackable mid-sections are preferably constructed as complete cylinders as opposed to the half cylinder base annular members 34, the complementary locking upper and lower surfaces ensuring that the base annular members remain in place.

In the embodiments of FIGS. 19 and 20, one of the base annular members 34 is simply placed in position at a predetermined location and the second base annular member 34 is positioned from the opposite side of the storage cask. The inner venting annulus 48 being formed due to the positioning of the first base member. However, an indexing cylinder, an indexing ring or adjustable screws may also be used to index the base annular member from the storage cask.

Figure 21:
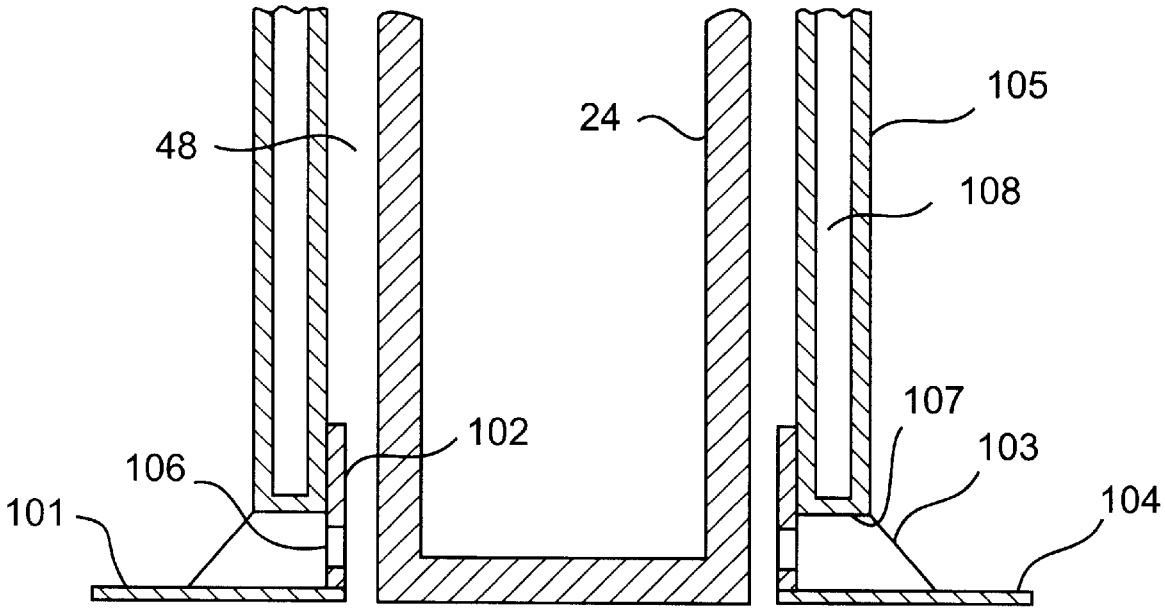
FIG. 21 is an elevational view, partially in section illustrating a double walled cylinder and separate base member.

FIG. 21 illustrates an alternative embodiment of the flak jacket protective cover of the present invention. A steel base member 104 includes a horizontal portion 101 and a vertical portion 102. The base member 104 can be constructed as either a complete cylinder or two half cylinders connected together by bolts or other fastening means. The horizontal portion 101 and the vertical portion 102 are welded to each other and include gussets 103 welded thereto to increase the strength of the connection and to provide a base for double walled cylinder 105. There are a plurality of gussets 103 spaced around the circumference of the base member 104. The vertical portion 102 includes venting ports 106 which communicate with the inner venting annulus 48 and the outside atmosphere. The venting ports 106 are located around the circumference of the base member 104 between the gussets 103. The gussets 103 include an upper surface 107 for supporting the double walled cylinder 105. Furthermore, the double walled cylinder 105 includes a hollow interior 108 which can be filled with water, sand, ceramic material, cement, or the like in order to increase the penetration resistance of the double walled cylinder 105.

In any of the above mentioned embodiments which include a base annular member and separate stackable mid-sections, it is also possible to make a single piece having a height which is equal to the height of the base annular member and stackable mid-sections combined. Although it is possible to construct the flak jacket protective cover of the present invention in this manner, it is preferable to use separate pieces since the weight of a single member may be too high.

Manifestly, the cement annuli which may be reinforced with steel bars, or the like, the annular venting annulus and the double wall annulus may be dimensioned for defeating shaped charges, such as used in anti-tank and terrorist weaponry. The protective cover in defeating the armor piercing weaponry thus provides a safeguard against nuclear incident in the event of terrorist attack upon the nuclear power generating facility.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A flak jacket protective cover for a transportable spent nuclear fuel storage cask comprising:

an indexing cylinder;

at least one venting port extending through the indexing cylinder; and a base connected to a bottom portion of the indexing cylinder, said base extending radially outwardly from an outer surface of said indexing cylinder around substantially the entire circumference thereof;

wherein said indexing cylinder is positioned concentrically at a spaced location from an outer surface of the storage cask to form an inner venting annulus between the indexing cylinder and the storage cask, and said at least one venting port communicates the inner venting annulus with the outer surface of the indexing cylinder.

2. The flak jacket protective cover according to claim 1, wherein said indexing cylinder includes first and second walls spaced apart from each other forming a hollow interior therebetween, and the hollow interior is filled with a material selected from the group consisting of water, sand, cement and ceramic material.

3. The flak jacket protective cover according to claim 2, wherein said at least one venting port is a tube extending between said first and second walls, said tube sealing the hollow interior from the outer surface of said indexing cylinder.

4. The flak jacket protective cover according to claim 1, wherein said indexing cylinder is made of steel.

5. The flak jacket protective cover according to claim 1, wherein said cover further comprises an annular base member positioned adjacent to the outside surface of said indexing cylinder.

6. The flak jacket protective cover according to claim 5, wherein said annular base member is supported on said base of said indexing cylinder.

7. The flak jacket protective cover according to claim 6, wherein said annular base member includes a venting port extending therethrough, said venting port being positioned in alignment with said venting port of said indexing cylinder.

8. The flak jacket protective cover according to claim 5, wherein said annular base member is formed from two half cylinders secured around said indexing cylinder from opposite sides of said indexing cylinder.

9. The flak jacket protective cover according to claim 8, wherein at least one of said half cylinders includes a venting port extending therethrough, said venting port is in alignment with said at least one venting port of said indexing cylinder.

10. The flak jacket protective cover according to claim 7, wherein said cover further comprises annular mid-pieces supported on the annular base member and an annular top supported on a top of said annular mid-pieces, said annular top including at least one venting port extending therethrough in communication with said inner venting annulus.

11. The flak jacket protective cover according to claim 9, wherein said cover further comprises annular mid-pieces supported on the annular base member and an annular top supported on a top of said annular mid-pieces, said annular top including at least one venting port extending therethrough in communication with said inner venting annulus.

12. The flak jacket protective cover for a transportable spent nuclear fuel storage cask according to claim 1, wherein said indexing cylinder further comprises:

a plurality of gussets connected between the indexing cylinder and the base, the gussets having a flat upper surface; and a double walled cylinder supported on the flat upper surface of the plurality of gussets, said double walled cylinder having a hollow cylinder capable of being filled with a material selected from the group consisting of water, sand, cement and ceramic material.

13. A flak jacket protective cover for a transportable spent nuclear fuel storage cask comprising:

a double walled indexing cylinder having first and second walls spaced apart to form a hollow interior; and at least one venting port extending through the indexing cylinder, wherein said indexing cylinder is positioned concentrically at a spaced location from an outer surface of the storage cask to form an inner venting annulus between the indexing cylinder and the storage cask, and said at least one venting port communicates the inner venting annulus with an outer surface of said indexing cylinder.

14. The flak jacket protective cover according to claim 13, wherein said cover further comprises a base connected to a bottom portion of the indexing cylinder, said base extending radially outwardly from the outer surface of the indexing cylinder around substantially the entire circumference thereof.

15. The flak jacket protective cover according to claim 13, wherein the hollow interior is filled with a material selected from the group consisting of water, sand, cement and ceramic material.

16. The flak jacket protective cover according to claim 13, wherein said indexing cylinder is made of steel.

17. The flak jacket protective cover according to claim 13, wherein said at least one venting port is a tube extending between said first and second walls, said tube sealing the hollow interior from the outer surface of said indexing cylinder.

18. A flak jacket protective cover for a transportable spent nuclear fuel storage cask comprising:

an annular concrete member positioned at a predetermined distance from an outer surface of the storage cask;

at least one venting port extending through said annular concrete member; and indexing means for spacing said annular concrete member at said predetermined distance from the storage cask, wherein an inner venting annulus is formed between said annular concrete member and the storage cask, and said at least one venting port communicates the inner venting annulus with an outer surface of said annular concrete member.

19. The flak jacket protective cover according to claim 18, wherein said indexing means is at least one screw adjustably supported on the annular concrete member and movable toward and away from the storage cask.

20. The flak jacket protective cover according to claim 19, wherein said at least one screw is supported by a threaded sleeve, said threaded sleeve being supported on said annular concrete member.

21. The flak jacket protective cover according to claim 18, wherein said indexing means is an indexing ring positioned concentrically around the outer surface of the storage cask.

22. The flak jacket protective cover according to claim 18, wherein said cover further comprises annular mid-pieces supported on said annular concrete member and an annular top supported on a top of said annular mid-pieces, said annular top including at least one venting port extending therethrough in communication with said inner venting annulus.

23. The flak jacket protective cover according to claim 18, wherein said indexing means is a guide having a plurality of vertical portions and a plurality of horizontal portions, said vertical portions for being positioned between the storage cask and the annular concrete member to position the annular concrete member at said predetermined position.

24. The flak jacket protective cover according to claim 18, wherein said annular concrete member is formed from two half cylinders secured around said indexing cylinder from opposite sides of the storage cask.

25. The flak jacket protective cover according to claim 18, wherein said at least one venting port is a cut-out formed on a bottom surface of the annular concrete member.

26. The flak jacket protective cover according to claim 25, wherein there is a plurality of said cut-outs formed on said bottom portion of said annular concrete member, said cut-outs spaced around the circumference of said annular concrete member.

27. The flak jacket protective cover according to claim 24, wherein an upper surface of each of said two half cylinders includes raised portions and lowered portions, said flak jacket protective cover further comprising at least one annular mid-piece positioned on said upper surface of said two half cylinders, a bottom surface of said at least one annular mid-piece having raised and lowered portions for engaging with the raised and lowered portions of the upper surface of the two half cylinders.

28. A flak jacket protective cover for a transportable spent nuclear fuel storage cask comprising:

an annular member positionable at a predetermined distance from an outer surface of the storage cask; and at least one venting port extending entirely through a thickness of said annular member, wherein an inner venting annulus is formed between said annular member and the storage cask when the annular member is positioned around the storage cask, and said at least one venting portion communicates the inner venting annulus with an outer surface of said annular member.

29. The flak jacket protective cover according to claim 28, wherein said at least one venting port is a cut-out formed on a bottom surface of the annular member, said cut-out extending entirely through a thickness of said annular member.

30. The flak jacket protective cover according to claim 29, wherein there is a plurality of said cut-outs formed on said bottom portion of said annular member, said cut-outs spaced around the circumference of said annular member.

31. The flak jacket protective cover according to claim 28, wherein said annular member is formed from two half cylinders secured around said indexing cylinder from opposite sides of the storage cask.

32. The flak jacket protective cover according to claim 31, wherein an upper surface of each of said two half cylinders includes raised portions and lowered portions, said flak jacket protective cover further comprising at least one annular mid-piece positioned on said upper surface of said two half cylinders, a bottom surface of said at least one annular mid-piece having raised and lowered portions for engaging with the raised and lowered portions of the upper surface of the two half cylinders.

33. The flak jacket protective cover according to claim 31, wherein said at least one venting port is a cut-out formed on a bottom surface of the annular member.

34. The flak jacket protective cover according to claim 32, wherein there is a plurality of said cut-outs formed on said bottom portion of said annular member, said cut-outs spaced around the circumference of said annular member.

* * * * *